US007069830B1

(12) United States Patent
Meyer

(10) Patent No.: US 7,069,830 B1
(45) Date of Patent: Jul. 4, 2006

(54) SURFACE REPAIR METHOD AND TOOL THEREFOR

(75) Inventor: Charles E. Meyer, Edwards, CA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 1103 days.

(21) Appl. No.: 09/596,432

(22) Filed: Jun. 19, 2000

(51) Int. Cl.
*B32B 35/00* (2006.01)
*B27B 21/00* (2006.01)

(52) U.S. Cl. ..... 83/13; 29/897.1; 30/507

(58) Field of Classification Search ..... 29/402.09, 29/402.11, 897.1; 83/13; 30/507, 508
See application file for complete search history.

(56) References Cited

U.S. PATENT DOCUMENTS 1,548,393 A * 8/1925 Strug ..... 30/509
2,011,484 A * 8/1935 Harman ..... 29/402.11 X
2,514,609 A * 7/1950 Roy ..... 83/835
3,229,361 A * 1/1966 Valacich ..... 29/402.11 X
4,095,635 A * 6/1978 Hutchins ..... 30/509
4,842,663 A * 6/1989 Kramer ..... 29/402.11 X
5,023,987 A * 6/1991 Wuepper et al. ..... 29/402.11
5,111,570 A * 5/1992 Baumgarten et al. . 29/402.11 X
5,190,611 A * 3/1993 Cologna et al. ..... 29/402.11 X
5,653,836 A * 8/1997 Mnich et al. ..... 29/402.11 X
5,928,448 A * 7/1999 Daws ..... 29/402.11 X
6,178,647 B1 * 1/2001 Kirk ..... 30/507

* cited by examiner

*Primary Examiner*—Charles Goodman
(74) *Attorney, Agent, or Firm*—Thomas C. Stover

(57) ABSTRACT

Provided is a method for repairing an aperture in a panel in which, a) a plug is inserted in a such aperture to fill same and project above the surface of the panel, b) the plug is adhered in the aperture and c) the plug is flush cut with such surface to repair the panel. Also provided is a tool for flush cutting such projection wherein a blade is mounted across a frame, which blade is mounted at about 90 degrees to the plane of such frame so as to be parallel with the surface of the panel when the frame is mounted upright thereon, to provide clearance for the hand that guides the frame while flush cutting the projection from the panel. Desirably the ends of the saw blade are recessed between smooth feet of the frame so that the blade is elevated slightly above the panel surface, to reduce or avoid scratching thereof during the flush cutting step.

8 Claims, 2 Drawing Sheets

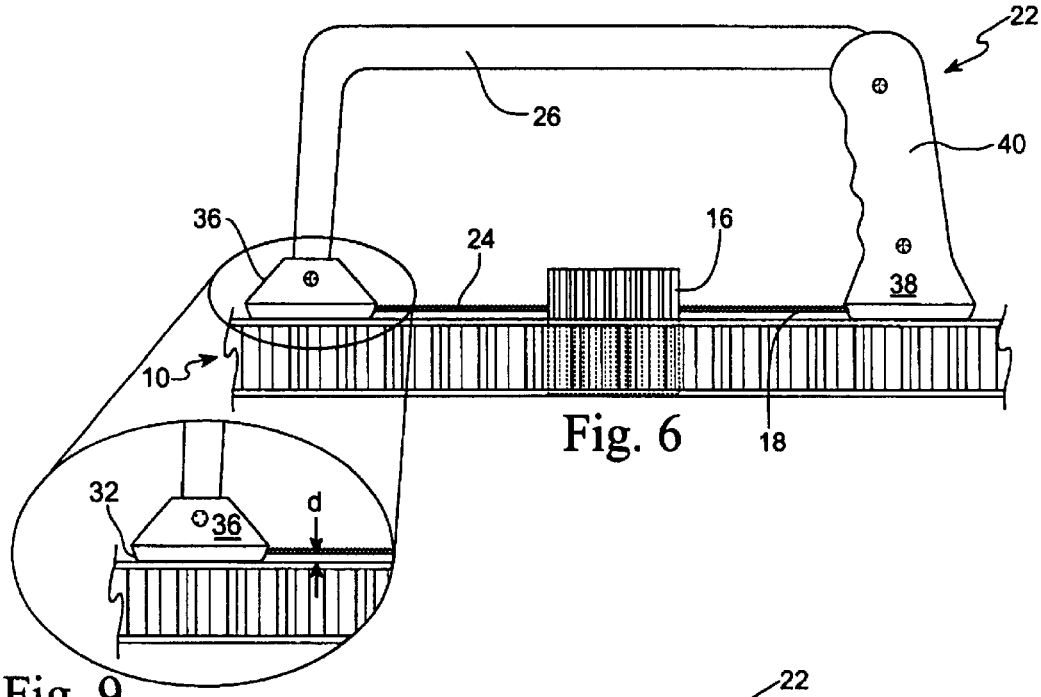
Fig. 6
Fig. 9
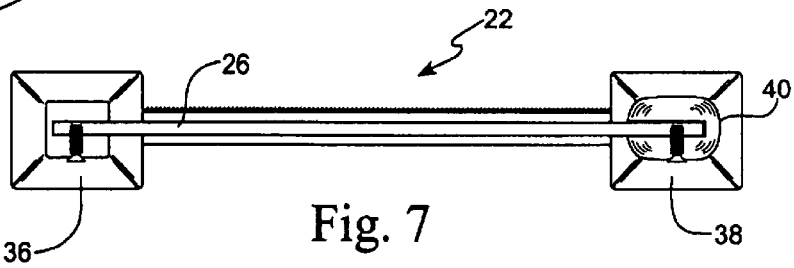
Fig. 7
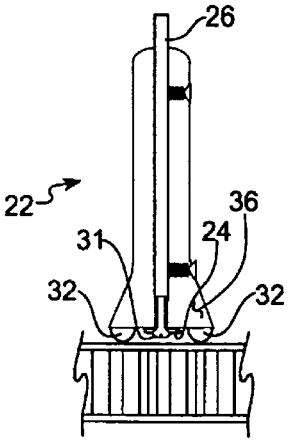
Fig. 10
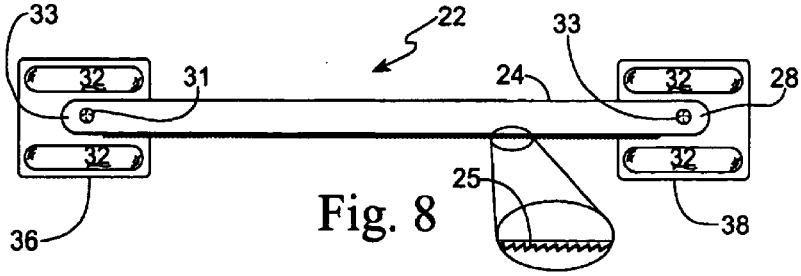
Fig. 8

SURFACE REPAIR METHOD AND TOOL THEREFOR

STATEMENT OF GOVERNMENT INTEREST

The invention described herein may be manufactured and used by or for the Government for governmental purposes without the payment of any royalty thereon.

RELATED APPLICATIONS

None

FIELD OF THE INVENTION

This invention relates to methods for repairing a damaged panel or other surface particularly by removal of the damaged portion and installation of a replacement portion.

BACKGROUND OF THE INVENTION

When panels, e.g., aircraft panels of aluminum skin and honeycomb core are damaged, repair is necessary. The present method of such repair is cutting around the damage and removing the resulting plug from the panel. Then one prepares a matching plug of undamaged material, e.g., of honeycomb core and inserting same into the aperture vacated by the damaged plug. This means that one has to estimate the thickness of such core, insert same and sand it flush with the panel surfaces.

Such prior art method is laborious and abrades the plug and panel surface(s) until the repair is flush.

Accordingly, there is need and market for a method of panel repair that overcomes the above prior art shortcomings.

There has now been discovered a method of panel repair that is less laborious and minimizes or reduces scratching and/or abrasion to the panel surface(s) in obtaining a flush insert panel repair.

SUMMARY OF THE INVENTION

Broadly, the present invention provides a method for repairing a hole or indent in a surface comprising a) inserting a plug or core into the hole or indent, that about fills same and projects above such surface and b) cutting the projecting portion of the plug off in the direction proximate to and parallel with the surface so that the remaining plug insert is flush or nearly so with the surface.

The invention also provides a tool for flush cutting a projection from a surface comprising a saw having a saw blade mounted across a frame, the blade being mounted at an angle to the plane of such frame so as to cut in a direction parallel to the surface and at an angle to such frame.

Definitions:

By "flush cut" as used herein, is meant cutting a plug or insert, nearly level with the surrounding surface of a panel, so it can be readily sanded down to full flushness with such surface.

By "aperture" as used herein, is meant an indent, a recess or a through hole in a surface, panel or other structure.

BRIEF DESCRIPTION OF THE DRAWINGS

The invention will become more apparent from the following detailed specification, and drawings in which;

FIG. 6 is a fragmentary elevation schematic view of the tool embodying the invention in operation, also shown in FIG. 3;

FIG. 7 is a top plan view of the cutting tool of FIG. 6;

FIG. 8 is a bottom plan view of the inventive cutting tool shown in FIGS. 6 and 3;

FIG. 9 is an end elevation view of the tool of FIG. 6;

FIG. 10 is an enlarged fragmentary schematic elevation view of components of the cutting tool of FIG. 6 and;

FIG. 11 is an enlarged fragmentary schematic elevation view of a component of the cutting tool of FIG. 8.

DESCRIPTION OF PREFERRED EMBODIMENTS

Figure 1:
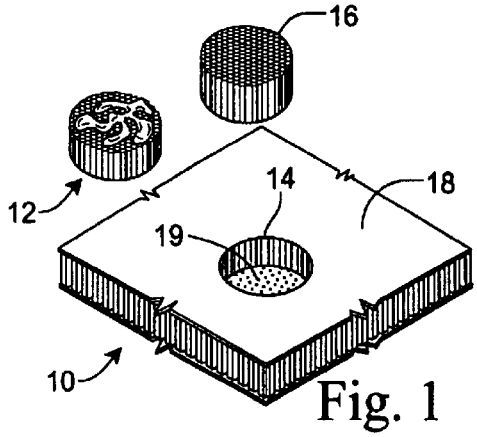
FIGS. 1 and 2 are perspective schematic views of core removal and replacement according to the present invention.
Figure 2:
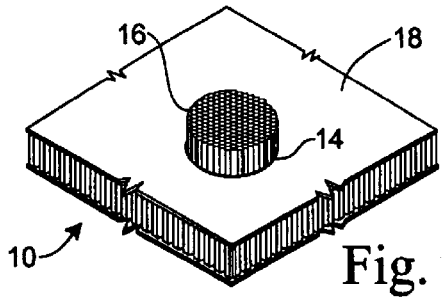

Referring now in detail to the drawings, panel 10 has a damaged portion 12 which has been cut out of such panel, leaving a recess or aperture 14 for which a replacement plug 16 has been cut of a size to fill the aperture 14 and yet project above the surface (or skin) 18 of the panel 10, which plug 16 is inserted into the aperture 14 as shown in FIGS. 1 and 2.

Figure 3:
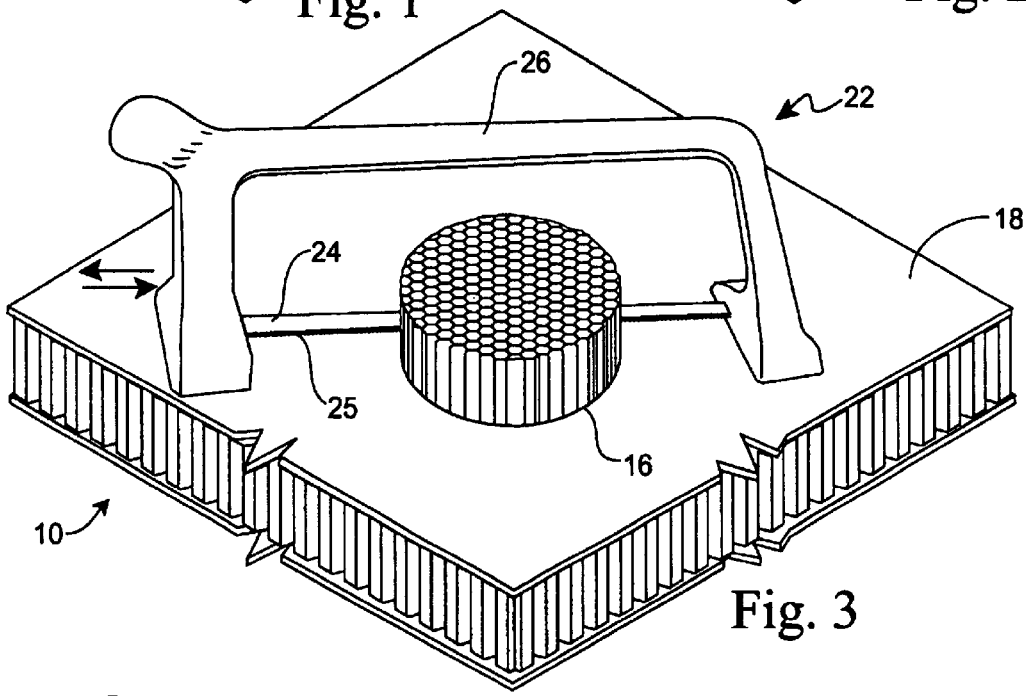
FIG. 3 is a fragmentary perspective schematic view of flush cutting the replacement core according to the present invention.

Again the plug 16 is of a greater thickness or height than the aperture 14 and thus projects above the surface 18 of the panel 10, as clearly shown in FIG. 3.

At this point the bow saw of the invention 22 has blade 24 with cutting edge 25 mounted across the frame 26, at an angle with the plane thereof, so as to cut the plug 16 in a direction about parallel with and proximate to the surface 18 of the panel 10, all as shown in FIG. 3.

Figure 4:
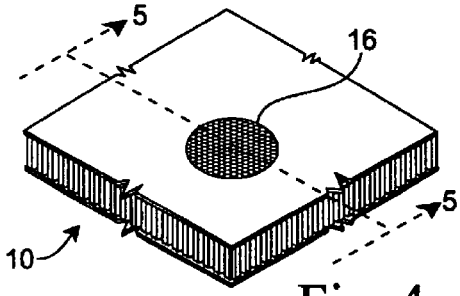
FIG. 4 is a fragmentary perspective schematic view of the repaired panel per the present invention.
Figure 5:
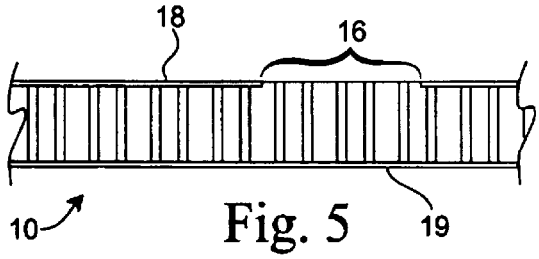
FIG. 5 is a fragmentary sectional elevation schematic view of the repaired panel of FIG. 4, taken on lines 5—5, looking in the direction of the arrows.

The resulting flush cut of such plug 16, in the panel 10, is shown in FIGS. 4 and 5.

Referring further to FIGS. 1 and 2, it should be noted that when an aluminum panel is dented or damaged, only the upper skin may be in need of repair, with the bottom skin of the panel 19 being relatively undamaged. In such case, it is desirable to employ a tool such as a router, with a pre-set depth of penetration, to rout (preferable through a template aperture) out the damaged portion of the panel without damaging such bottom skin as indicated in FIG. 1. The so drilled-out recess or aperture 14 is then measured, e.g., by placing a tape thereacross and then cutting around the circumference or periphery of the aperture 14, to obtain a disc as template which can be adhered atop a reserve aluminum panel (of greater thickness than the one being repaired). Then a plug is cut from such reserve panel by scribing a cutting tool around the edges of such template disc and through such panel, which plug is then coated with adhesive on bottom and sides thereof and inserted into the aperture 14 and pressed or tapped down into contact or near contract with the bottom skin and dried under heat and vacuum (to collapse bubbles in the adhesive) and flush cut, as indicated in FIGS. 2 and 3 hereof. Then a patch or disc of fiberglass or metal, e.g., Al, can be adhered in place over the plug to seal same as desired.

Again the resulting repair is shown in FIGS. 4 and 5 where plug 16 is inserted and flush cut in the panel 10 with minimal or no damage to the lower skin 19, as shown in FIG. 5.

Now, if the hole is through the panel and both skins, the core and skins are routed out and the skin below is patched with an overlapping adhesive-coated disc. Then a plug is cut, coated with adhesive, inserted through the aperture in the upper skin and the repair processed as before.

The tool:

That the bow saw 22 has its blade 24 mounted at an angle with the plane of its frame 26, so as to cut parallel with and proximate to the surface 18 of the panel 10 and thus flush cut the plug 16, is shown in FIG. 6, to augment the view thereof shown in FIG. 3.

The bow saw 22 has its frame 26 mounted to pedestal 36 and has handle 40 which terminates in pedestal 38, also mounted to the frame which pedestals rest on smooth pads 32, as shown in FIGS. 6–10.

Views of the frame 26 (of such saw) are shown in FIGS. 6, 7, and 9.

Views of the cutting blade 24 are shown in FIGS. 6, 8, 9, and 11.

The bottom surface of the blade 24 is secured at its ends 28 and 30, in a recess slightly above downwardly projecting polytetrafluoroethylene (Teflon®) pads 32, as shown or indicated in FIGS. 6, 8, 9, and 10 so as to elevate such blade slightly above the surface 18 of panel 10 by a distance 'd', per FIG. 10 hereof. The so mounted blade permits the bow saw 22 of the invention to glide across the surface 18 of the panel 10, while sawing through the plug 16, with minimal or no scratching or abrading of such surface, as indicated in the above drawings.

As indicated in FIG. 8, the blade 24 of the invention preferably has a single cutting edge 25 but can have a second cutting edge, where a double-edged blade is desired per the invention.

Also pads 32 of pedestals 36 and 38 of the cutting tool 22 are advantageously beveled or curved in one or more directions, to slide over surfaces rougher than aluminum skin such as sheetrock, wood and the like, to flush cut projections therefrom.

Thus the cutting tool of the present invention has at least 3 main innovations. The first is situating the saw blade parallel to the skin's surface, allowing a flush cut of the honeycomb material. This allows a flush cut for aircraft repairs, with little or no scratching of the panel skin, making for a high quality repair. The second innovation is that the bottom of the two pedestals of the tool have a smooth coating or glide pads thereunder, e.g., of phenolic or other smooth material to permit such tool to glide on the panel surface while minimizing or precluding scratching thereof. The third innovation is the recessing of the saw blade between the glide pads to elevate the blade slightly above the surface of the panel to minimize scratching or abrasion thereof while cutting the plug off proximate such skin, e.g., as indicated in FIGS. 3 and 6 hereof.

Per the invention, the cutting blade is raised above the surface of the panel skin a distance 'd' per FIG. 10 hereof, e.g., 0.5–2 mils for near flush cutting of the plug from the panel or other surface. Any remaining projection of such plug can be readily sanded down in close proximity or fully flush with such skin or other surface.

The saw of the invention desirably employs a hacksaw or other blade and is highly suitable for cutting through metal or plastic, e.g., cutting through aluminum and phenolic honeycomb material, to flush cut a projection from a surface, with little or no scratching of such surface. Accordingly the tool of the invention, e.g., a modified bow saw, can be employed in any application where a flush cut of a projection from a surface is required, with little or no damage to such surface.

As indicated above, a preferred application of the method of the invention is to repair damage to aircraft or other panels by inserting a plug into the damaged panel and flush cutting same therein. Aluminum or phenolic honeycomb plugs are highly suitable in repairing damage to such panels. However various other plugs of, e.g., wood, metal or plastic can be employed, as desired, per the invention.

Also such plugs can be bonded in a panel aperture by adhesives such as resin or epoxy adhesives or various other available adhesives.

Various saw blades can be used in the cutting tool of the present invention of various metals such as blades of steel or alloys thereof, including stainless steel having saw teeth of various sizes, e.g., 18, 24 or 32 teeth per inch. Preferably, hacksaw blades are employed per the invention.

The foot pads of the cutting tool of the invention project slightly below the cutting blade and have a smooth surface (e.g., with rounded edges, per FIGS. 9 & 10) of various materials, e.g., wood, metal or plastic such as phenolics, polyolefins including polyethylene or various other plastics e.g., Teflon®.

As indicated in FIG. 9, the blade 24 on the cutting tool of the invention, is secured to the frame 26 thereof and recessed between smooth foot or glide pads 32 thereof by fasteners, e.g., screws 31 and 33, as shown or indicated in FIGS. 8 and 9 hereof.

The cutting tool of the invention can have various frames, rounded, angular or a combination thereof (which include feet or pedestals) and preferably with a handle mounted thereto.

Accordingly, the flush cutting tool of the present invention provides a high quality panel or surface repair while significantly reducing man-hours per repair, providing structurally sound repairs, reducing rework errors and avoiding damage to skin or surface of the structure. Further, the tool of the present invention has application whenever a flush cut needs to be made on any surface, whether on panel, sheetrock, wood, ceramic, or other type surface that needs to be flush cut, e.g., in the construction industry.

What is claimed is:

1. A method of repairing a hole or indent in a surface comprising, a) inserting a plug into said hole or indent that substantially fills same and projects above said surface and b) cutting said plug off about flush with said surface by employing a saw blade that is supported just above said surface by recessing portions of said blade in or between glide pads to avoid scratching or abrading same when sawing through said plug.

2. A method for repairing an aperture in a panel comprising, a) sizing a plug to about fit said aperture and project therefrom b) inserting said plug into said aperture so that said plug extends as a projecting portion above a surface of said panel and c) cutting off said projecting portion about flush with said surface by employing a saw blade that is supported just above said surface by recessing portions of said blade in or between glide pads to avoid scratching or abrading same when sawing through said plug.

3. The method of claim 2 wherein the step is added of sanding the top of said plug into closer flushness with said surface.

4. The method of claim 2 wherein said plug is adhered within said aperture and said portion is cut off by sawing said plug in a direction substantially parallel with said surface and in close proximity thereto.

5. A method for repairing a damaged portion of a panel comprising, a) cutting out the damaged portion and leaving an aperture therein, b) cutting a plug to fit the aperture and project therefrom, c) inserting said plug into said aperture so that said plug extends as a projecting portion above a surface of said panel, d) adhering said plug to a surface of said aperture and e) cutting off said projecting portion about flush with the panel surface by a saw blade supported just above said surface by recessing portions of said blade in or between glide pads to minimize contact therewith.

6. The method of claim 5 wherein said saw blade is mounted across a frame and about parallel to said surface.

7. The method of claim 6 wherein said saw blade is recessed into smooth glide pads of said frame to elevate the blade just above said surface to avoid scratching or abrading same when sawing through said plug.

8. A method for repairing a damaged portion in a sandwich panel which has a honeycomb core between two skins, one of which is damaged, the other being substantially undamaged comprising, a) routing out the damaged portion of said core through the damaged skin, while restraining the depth of routing, so as not to seriously abrade the undamaged skin on the other side of said panel and thereafter b) cutting a replacement plug to measure, c) inserting said plug into the routed hole so said plug projects above said panel, d) adhering said plug in said aperture and e) nearly flush cutting same by employing a saw blade elevated above the panel skin by recessing portions of said blade in or between glide pads.

* * * * *